US007155782B2

(12) United States Patent
Napurano

(10) Patent No.: US 7,155,782 B2
(45) Date of Patent: Jan. 2, 2007

(54) REVERSIBLE FASTENER

(76) Inventor: Joseph Napurano, 109 Pleasant St., South Natick, MA (US) 01760

( * ) Notice: Subject to any disclaimer, the term of this patent is extended or adjusted under 35 U.S.C. 154(b) by 118 days.

(21) Appl. No.: 10/960,178

(22) Filed: Oct. 7, 2004

(65) Prior Publication Data

US 2005/0081338 A1 Apr. 21, 2005

Related U.S. Application Data

(60) Provisional application No. 60/511,525, filed on Oct. 15, 2003.

(51) Int. Cl.

| | |
|---|---|
| ***A44B 1/26*** | (2006.01) |
| ***A44B 1/18*** | (2006.01) |
| *A44B 1/02* | (2006.01) |
| *A43B 7/26* | (2006.01) |

(52) U.S. Cl. ..... 24/114.1; 24/91; 24/114.9

(58) Field of Classification Search ..... 24/102 FC, 24/114.1, 114.2, 114.7–114.11, 3.1, 66.9, 24/90.1, 91, 93, 103, 41.1–48, 113 R, 114; 63/31; 36/11.5, 94, 136, 137

See application file for complete search history.

(56) References Cited

U.S. PATENT DOCUMENTS

| | | | | | |
|---|---|---|---|---|---|
| 39,935 | A * | 9/1863 | Lambert | 24/114.7 |
| 53,333 | A | 3/1866 | Porter | 24/114.2 |
| 756,047 | A | 3/1904 | Pejchar | 24/102 CF |
| 915,678 | A * | 3/1909 | Kantor et al. | 63/31 |
| 1,430,715 | A * | 10/1922 | Zitting | 2/80 |
| 1,567,096 | A * | 12/1925 | Anderton, Jr. | 2/125 |
| 1,669,537 | A * | 5/1928 | Schaffer | 24/713 |
| 1,740,506 | A * | 12/1929 | Grosser | 24/713 |
| 1,768,381 | A * | 6/1930 | Stewart et al. | 2/128 |
| 1,975,285 | A * | 10/1934 | Pearse | 2/128 |
| 2,597,887 | A * | 5/1952 | Meeker | 24/97 |
| 2,598,281 | A * | 5/1952 | Meeker | 24/97 |
| 2,638,649 | A * | 5/1953 | Meeker | 24/97 |
| 2,928,191 | A * | 3/1960 | Meltzer | 36/94 |
| 3,217,514 | A * | 11/1965 | Newman | 63/31 |
| 3,613,393 | A * | 10/1971 | Lamoureux | 63/14.5 |
| 4,471,510 | A | 9/1984 | DeRosa | 24/90 R |
| 4,726,200 | A * | 2/1988 | Carter | 63/15 |
| 4,970,878 | A * | 11/1990 | Lee | 63/23 |
| 6,032,486 | A * | 3/2000 | Uchin | 63/31 |
| 6,550,276 | B1 * | 4/2003 | Frank | 63/31 |

* cited by examiner

*Primary Examiner*—Katherine Mitchell
*Assistant Examiner*—Ruth C. Rodriguez
(74) *Attorney, Agent, or Firm*—Barlow, Josephs & Holmes, Ltd.

(57) ABSTRACT

A reversible fastener that can be positioned in one of two alternate display positions without removing the fastener from the underlying garment is provided. The unique configuration of the fastener allows it to be rotatably coupled to a garment in a manner that facilitates the reversibility of the fastener without requiring its removal. The reversible fastener is useful in a variety of applications including garments, jewelry and footwear. Further, one embodiment of the present invention is also useful in providing a structural anchoring assembly.

11 Claims, 10 Drawing Sheets

REVERSIBLE FASTENER

CROSS-REFERENCE TO RELATED APPLICATIONS

This application is related to and claims priority from earlier filed U.S. Provisional Patent Application No. 60/511,525, filed Oct. 15, 2003, the contents of which is incorporated herein by reference.

BACKGROUND OF THE INVENTION

The present invention relates generally to a novel fastener configuration. More specifically, the present invention relates to a new decorative closure fastener for a use on a garment wherein the fastener includes two different ornamental surfaces that can be easily reversed to display either side as desired.

In order to hold the edges of garments such as shirts, blouses, dresses or jackets together, snap fasteners or buttons are commonly employed. In general buttons found on a large variety of garments are generally nondescript and have an appearance that is minimized in favor of their function. However, in other applications buttons are also provided to enhance the garments appearance or to provide additional ornamentation. In particular, with regard to ladies' blouses and men's formal dress wear, buttons play an important role in completing the overall appearance of the garment. When relatively inconspicuous buttons are employed, a more severe and businesslike appearance is presented, for example it is common to provide a plain white button on a white dress shirt. However, when a garment is intended for a fancier occasion, elaborately decorated or decorative buttons having contrasting color make the garment more suitable for dressy or leisure wear. Because of the differentiation in the ornamentation of garments depends directly from the occasion for which they will be worn or the particular taste of the wearer, a woman may very often have somewhat similar blouses or dresses which differ only in the buttons used on the dress as to whether it is suitable for business occasions or for more dressy leisure time activities. Further, as is common in the tuxedo rental business, a dress shirt is provided with white buttons sewn in place and an additional set of holes into which an alternate button tack may be used to provide a different appearance.

One prior art attempt at providing a button having a changeable appearance is shown in U.S. Pat. No. 2,597,887, issued to Meeker, which discloses a cuff link assembly that includes a reversible front button. The cuff link has a shaft that extends upwardly to rigidly connect to a rear surface of a central rectangular head member. The reversible portion of the button lies around the central rectangular member. The reversible portion is retained by a pin that allows the reversible portion to flip relative to the central head and is retained in either a first or second position by detents that engage the central head. It is of note that the central head is rigidly retained in a fixed position relative to the mounting shaft of the button. Therefore only the periphery of the button can be reversed.

Another prior art reference, U.S. Pat. No. 4,471,510, issued to DeRosa, is directed to a two piece interchangeable button. This reference discloses a button that has a first retaining member that is attached to the garment. The decorative portion is slidably received by the mounting portion utilizing interlocking members that include a channel on the mounting portion and an interlocking tab on the decorative portion. The user can maintain any variety or number of decorative button faces and change them as desired by sliding out the decorative portion and replacing it with another different button cover. In this case however the user is required to retain and store a variety of different covers as each set must be removed to allow the use of an alternate set.

Both U.S. Pat. No. 756,047, issued to Pejchar and U.S. Pat. No. 53,333, issued to Porter, disclose swivel mounted buttons. In particular, they are both directed to a toggle type button having an elongated shape wherein the button is inserted through a button hole in a parallel orientation and twisted to a position that is substantially perpendicular to the button hole to retain the button in place. While these disclosures disclose a general principle of a swivel mount for a button, they are lacking in any disclosure related to the ability to have changeable ornamental features.

Accordingly, there is a need for a button that includes an interchangeable external appearance to permit the transformation of a garment to which it is attached. Further there is a need for a fastener that allows for a garment to have an interchangeable external appearance without having to utilize a variety of additional small elements and without having to remove the button from the garment.

BRIEF SUMMARY OF THE INVENTION

In this regard, the present invention provides for a fastener device that can be easily reversed to change its ornamental appearance. In accordance with the present invention a reversible button type fastener is provided. While the present invention is described as a button, for purposes of this disclosure a button should be interpreted to include any type of button style fastener including but not limited to flat buttons, domed buttons, ball shaped buttons or toggle style buttons. As will be described in more detail below, the present invention is primarily directed at providing a button that has a unique configuration and attachment method that allows it to be attached to a garment in a manner that wherein the button can be easily reversed between two different display positions without having to remove-the button from the garment.

A first embodiment of the invention is shown as a traditional flat round button having one side that is black and one side that is white. The button includes two channels that extend along its diameter from the edge of the button towards its center. The channels do not extend entirely to the center thereby leaving a central portion attaching the two halves of the button. This central portion of the button serves as the means by which the button is anchored to the garment. Once the button is anchored to the garment it can be seen that the button is easily reversed between black and white by pinching the garment, rotating the button to allow the pinched fabric to pass through one of the channels and then flattening the fabric behind the button with the new side being in the display position. It should be appreciated that this general concept can also be achieved by providing only one channel in the button. In this case the button can only be rotated in one direction as compared to the two channel embodiment above but remains reversible within the scope of the present invention. Further, if the material to which the button is attached is not flexible enough to be pinched and still pass through the slot provided, the button can be fastened using an elastic material. In this manner the button can be pulled upwardly from the garment and rotated allowing the fastener material itself to pass through the slot provided in the button rather than the garment material. While this flat button embodiment is primarily shown as being circular, clearly any shaped button such as square, rectangular, triangular, trapezoidal, star, etc. are also intended to be within the scope of the disclosure. Further, the slot may be provided in such a manner that the side walls of the channel are tapered obliquely relative to the display surface of the button. When the walls of the channel are tapered it allows the channel to be masked giving the button a traditional appearance.

Other embodiments include a spherical button or a toggle button where a channel is formed around the entire circumference of the button. The button is then fastened using thread or elastic that is passed around this channel. To provide additional security to retain the fastener onto the garment, this type button may include a hole that passes through its center whereby the fastening material passes through the bore. For toggle shaped buttons fastened in this manner the fastening material must be elastic to allow the toggle to be pulled upwardly away from the garment and flipped into the reversed position.

It should be further appreciated that in terms of garments, the present invention is useful in traditional applications wherein a button is utilized to serve as a closure element. The present invention is also useful on garments wherein a toggle type device is indicated such as in a sandal that includes a strap that extends from the sole and between the wearer's toes to terminate in a toggle.

Accordingly, it is an object of the present invention to provide a reversible fastener device having alternate ornamental surfaces wherein the fastener can be reversed without removing the fastener from the garment to which it is attached. It is a further object of the present invention to provide a reversible fastener that has at least two alternate ornamental appearances wherein the fastener can be placed into a variety of display positions without the addition or removal of extraneous elements.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
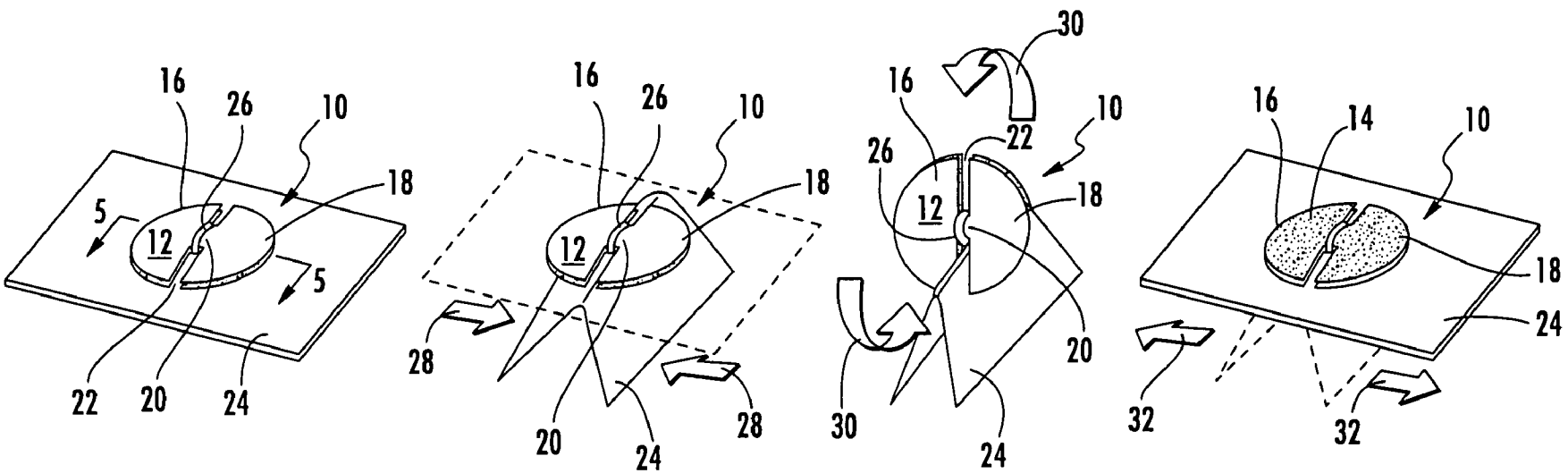
FIG. 1 is a diagrammatic step by step illustration of the operation of a first embodiment of the reversible fastener of the present invention.

Now referring to the drawings, a reversible fastener device is shown and generally illustrated at 10 in the figures. As can be seen the fastener is generally depicted as a button having a traditional flat button appearance. As stated earlier, for simplicity and clarity of illustration, the present invention is generally described as a button and depicted in general as a flat button. However, this general depiction is not meant to be limiting and for purposes of this disclosure a the flat button depicted should be interpreted to include any type of button style fastener including but not limited to flat buttons, domed buttons, ball shaped buttons or toggle style buttons. Further, while the term button is utilized, the reversible element of the invention, as will be shown below has applicability in a variety of contexts outside the traditional environment typically associated with term button. As will be described in more detail below, while the present invention is primarily directed at providing a button that has a unique configuration and attachment method that allows it to be attached to a garment in a manner that wherein the button can be easily reversed between two different display positions without having to remove the button from the garment, it is also intended to encompass a variety of environments into which such a device may be incorporated.

Turning to FIG. 1, an embodiment of the present invention is depicted in the form of a flat button 10 having a first side 12 and a second side 14 opposite the first side 12, wherein the first 12 and second 14 sides have different ornamental appearances. In this case the first side 12 is illustrated as being white and the second side 14 is illustrated as being black. The button 10 has left 16 and right 18 side portions that are connected by a shaft portion 20 that extends between the left 16 and right 18 side portions. In this manner, the left 16 and right 18 sides are maintained in spaced apart relation defining a narrow channel 22 extending there between from the edge of the button 10 to the shaft portion 20. The button 10 is fastened to a substrate material 24 utilizing any suitable fastening element 26 such as a thread, yam, plastic strip or metal staple. The fastening element 26 serves to engage both the shaft portion 20 and the underlying substrate 24 thereby holding the button 10 in attached relation to the substrate 24. The fastening element 26 may simply loop over the shaft portion 22 or wrap fully around the shaft portion 22 as it then engages with the substrate material 24.

While the button in FIG. 1 is illustrated as a flat button 10 having one white side and one black side, it can be appreciated by one skilled in the relevant art that any variety of ornamental elements can be combined and placed on the first 12 and second 14 opposing sides of the button 10. The button 10 could utilize any variation of color and texture to provide contrasting first 12 and second 14 sides. For example one side could be colored and smooth while the opposite side may be the same color but textured. The opposing sides 12, 14 may have different colors, textures or profiles and still fall within the present invention. Further, while this flat button 10 embodiment is primarily shown as being circular, clearly any shaped button such as square, rectangular, triangular, trapezoidal, star, etc. are also intended to be within the scope of the disclosure.

One manner in which the reversible fastener of the present invention may operate is illustrated in the sequential diagrams in FIG. 1. Starting on the left of the figure, the button 10 is shown lying flat on the substrate material 24 with the white side 12 showing. The next picture shows that the substrate 24 is pinched together as indicated by the two arrows 28. In the third picture, the button is shown being rotated as indicated by the arrows 30 whereby the pinched substrate 24 passes through the channel 22 provided between the left 16 and right 18 sides of the button. Finally, in the fourth picture, once the button 10 is in the reversed position, with the black side 14 showing, the substrate 24 is returned to its original flat state as indicated by the arrows 32. In this manner is can be seen that the present invention provides a fastener 10 that is easily reversible without having to remove the fastener 10 from the substrate 24 and without having to remove portions of the button 10 itself.

Figure 2:
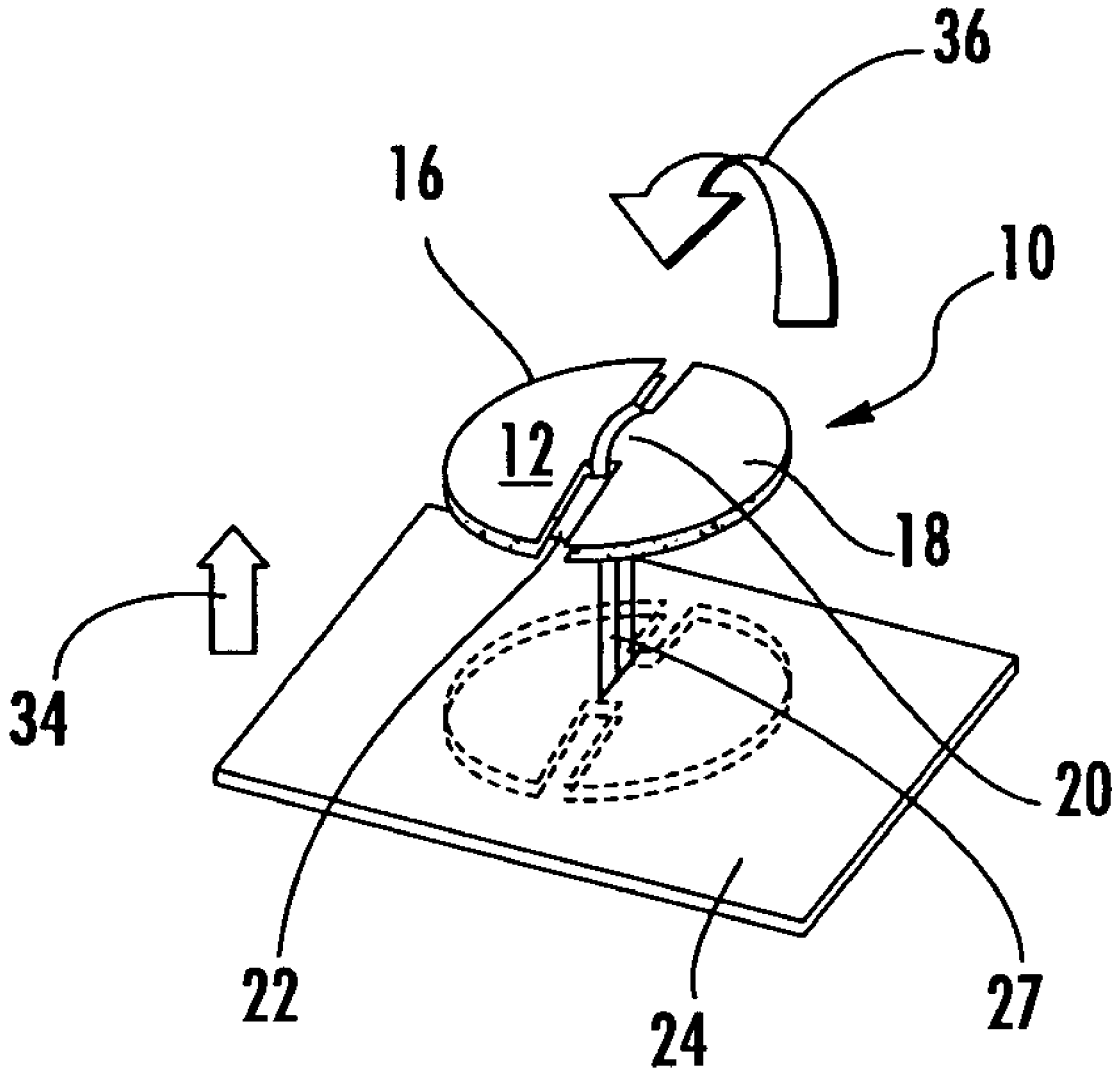
FIG. 2 is an illustration of an alternate means of attachment and operation of the reversible fastener of FIG. 1.

Turning now to FIG. 2, an alternate means for attaching the button 10 to a substrate 24 is illustrated. In this case the button 10 is show attached to a substrate 24 that is not particularly flexible. In particular, the substrate material 24 is not amenable to being pinched to allow passage through the channel 22 in the button 10. Instead, the button 10 is attached to the substrate using an elastic fastening means 27. Accordingly, in operation, the button 10 is lifted from the substrate stretching the elastic fastening means 27 as shown by the arrow 34. The fastener 10 is then rotated in accordance with the second arrow 36 to reverse the display face of the button 10. In this embodiment, the elastic fastening means 27 itself passes through the channel 22 in the button 10 rather than the pinched substrate 24. Once the button 10 is rotated it is released and the elastic fastening means 27 draws the button 10 back down onto the substrate 24.

Figure 3:
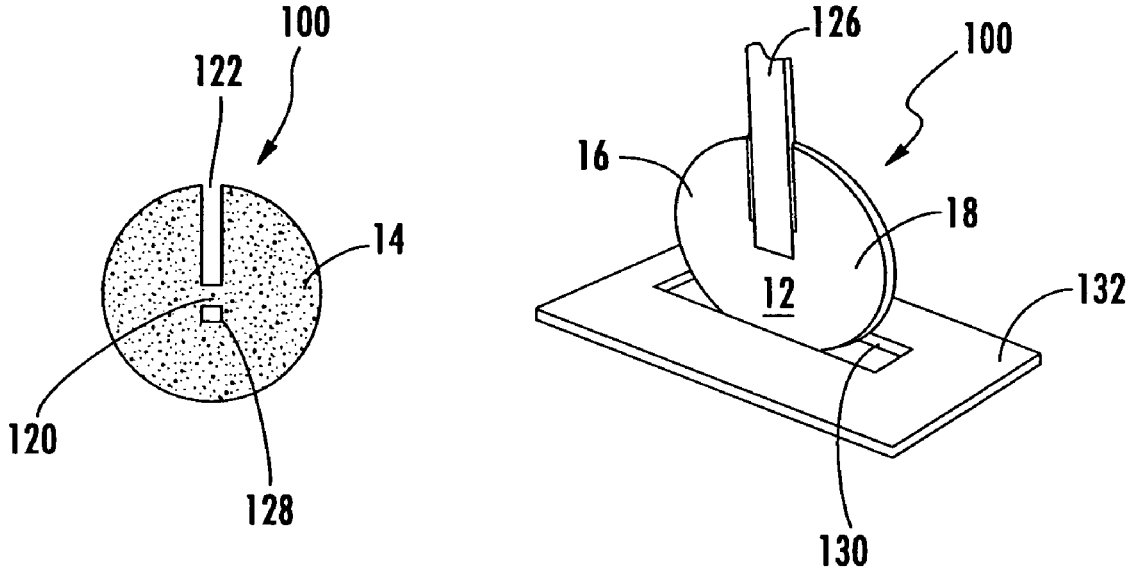
FIG. 3 is a diagrammatic view depicting a second embodiment of the reversible fastener of the present invention.

In FIG. 3 an alternate embodiment of the button itself is shown and illustrated generally at 100. In this embodiment, the button 100 includes left 16 and right 18 sides as described above, however, a channel 122 is provided only along half of the diameter of the button 100. Opposite the channel 122 on the other side of the shaft portion 120 a hole 128 is provided to allow the fastening means 126 to engage the shaft portion 120 but the channel 122 does not extend on that side of the shaft portion 120. This embodiment functions identically to the embodiment described above in all respects except that the button 100 can only be rotated in one direction rather that two as provided above. In this embodiment it is anticipated that the reversible fastener 100 will also function well in an anchoring application wherein the reversible fastener 100 is rotated so that the plane of the fastener 100 lies in alignment with the fastening means 126 itself. The button 100 is then inserted through an opening 130 in an object to be retained 132 and rotated to a position perpendicular to the fastening means 126 thereby preventing the button 100 from being withdrawn from the opening 130 into which it was inserted.

Figure 4A:
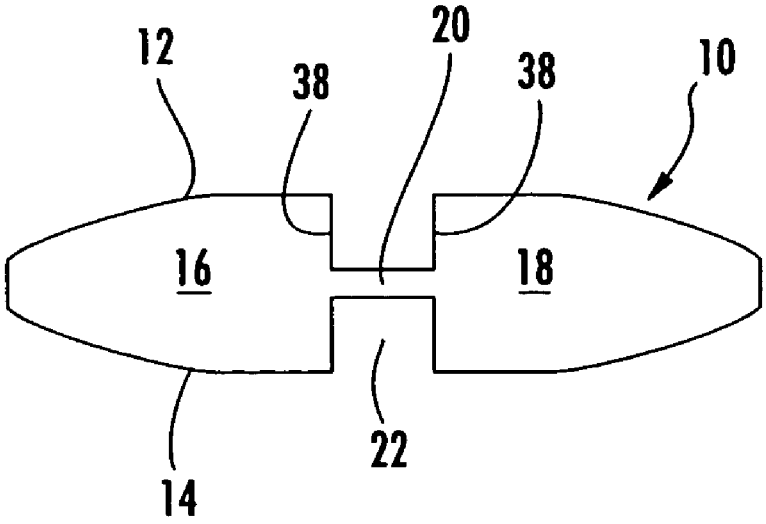
FIG. 4*a* is an end view showing one configuration of the reversible fastener of the present invention.
Figure 4B:
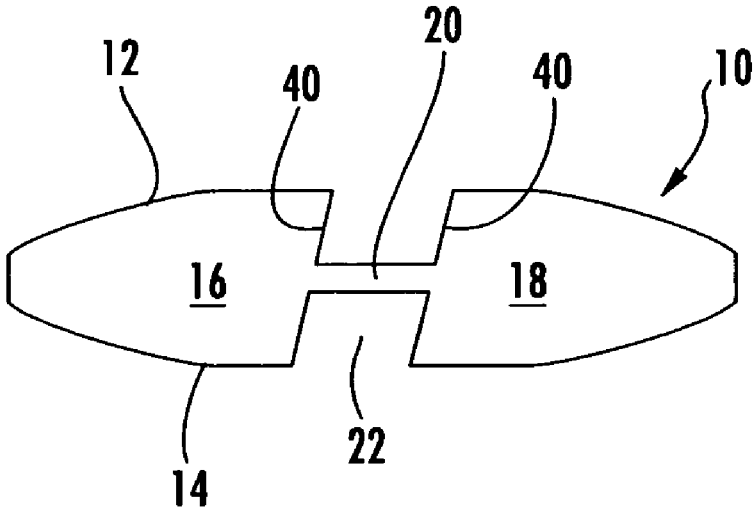
FIG. 4*b* is an end view showing an alternate configuration of the reversible fastener of the present invention.

FIGS. 4*a* and 4*b* illustrate the side view for two configurations of the reversible fastener 10 of the present invention. In FIG. 4*a*, the side walls 38 of the channel 22 extending from the front 12 of the button 10 to the rear 14 of the button 10 are substantially perpendicular to the front face 12 of the button 10. In FIG. 4*b*, the walls 40 are shown at an angle relative to the front face 12 of the button 10. In this configuration, the appearance of the channel 22 as viewed from the front face 12 of the button 10 are minimized thereby providing the channel 22 with a narrower appearance without reducing the actual dimension of the channel 22 and restricting the ability of the substrate material 24 to pass through the channel 22.

Figure 5A:
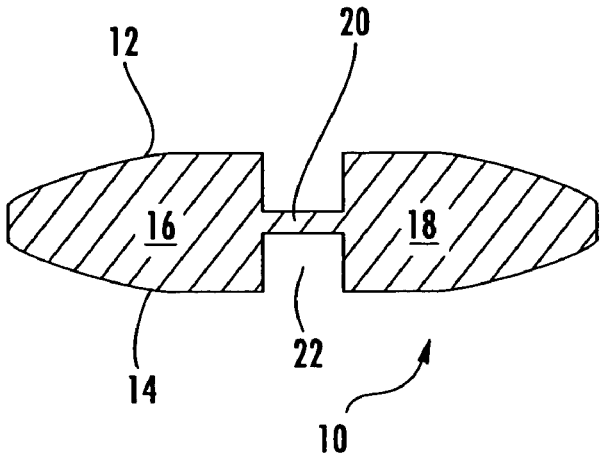
FIG. 5*a* is a cross-sectional view of the reversible fastener taken along the line 5—5 in FIG. 1.
Figure 5B:
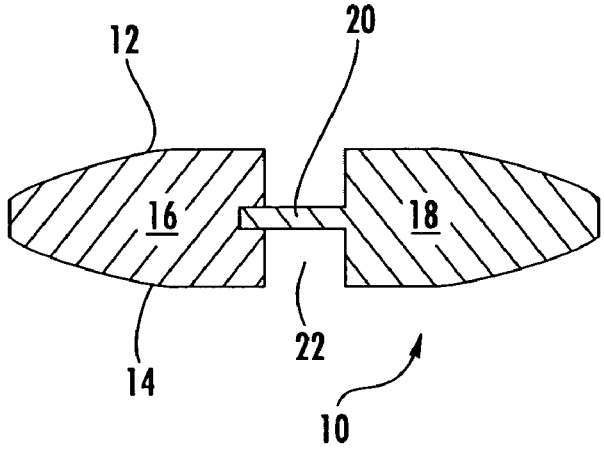
FIG. 5*b* is an alternate cross-sectional view of the reversible fastener taken along the line 5—5 in FIG. 1.
Figure 5C:
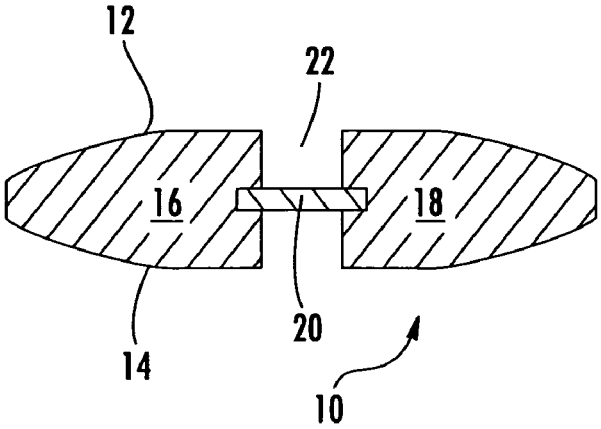
FIG. 5*c* is a second alternate cross-sectional view of the reversible fastener taken along the line 5—5 in FIG. 1.

FIGS. 5*a*, 5*b* and 5*c* show three possible constructions for the button 10 of the present invention. These cross sectional views illustrate that the button 10 can be formed entirely monolithically as one single piece. Similarly, as shown in FIG. 5*b* the button 10 can be molded in two pieces and then assembled to form a single button 10. In this case, the shaft portion 20 may be received and retained in the second side 16 of the button 10 frictionally. Alternately, an adhesive may be employed or the second side 16 of the button may be insert molded around the end of the shaft 20. The example in FIG. 5*c* illustrates that the shaft portion 20 may be insert molded into both the left 16 and right 18 sides of the button 10 thereby allowing the shaft 20 to be provided as a metal element while the balance of the button 10 is formed from an alternate material such as plastic. Ultimately, the method of fabrication is governed by the selection of particular materials used to form the button 10, the desired end appearance of the button 10 and the method by which the button 10 is to be manufactured. These cross sections are shown in order to illustrate that a variety of materials and methods of manufacture are anticipated by the present disclosure the illustrations are not meant to be limiting in that all manufacturing methods are intended to fall within the scope of the present disclosure.

Figure 6:
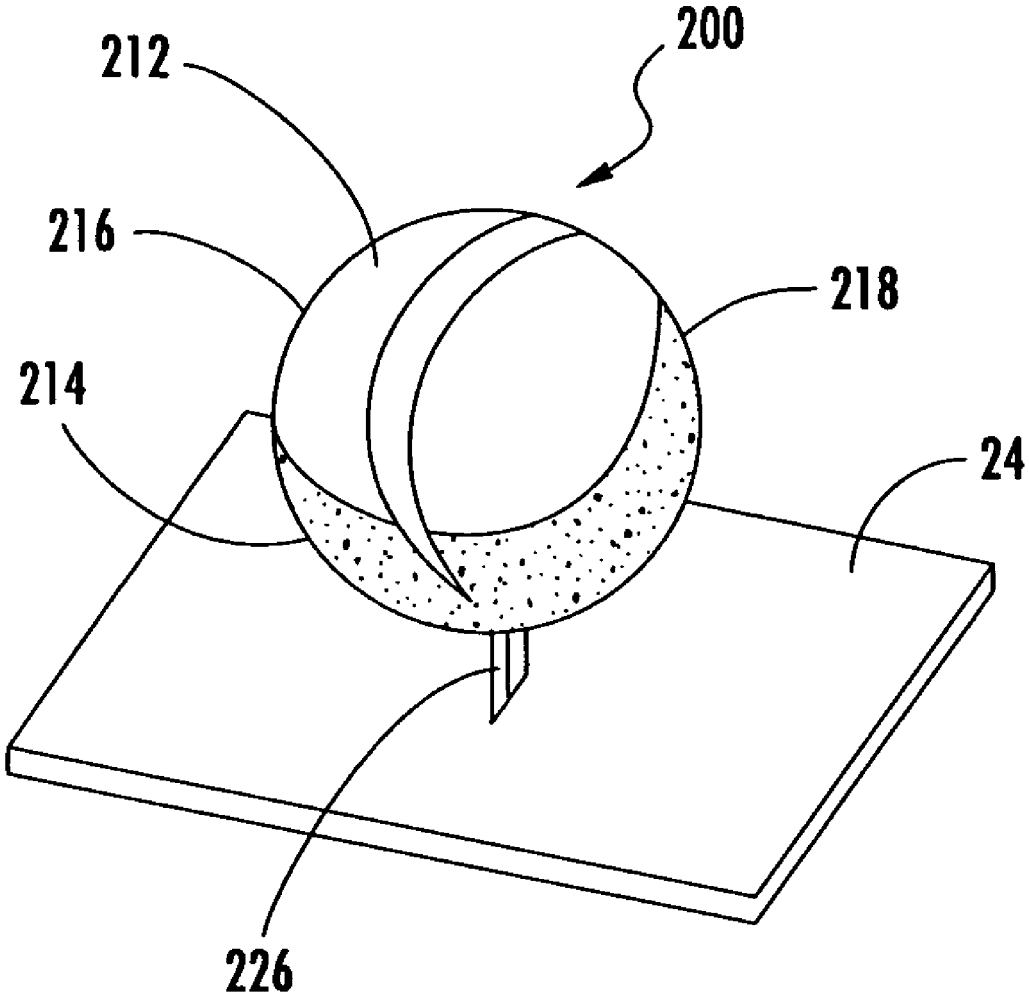
FIG. 6 is a diagrammatic view depicting a third embodiment of the reversible fastener of the present invention.

Turning now to FIG. 6, another alternate embodiment of the present invention is shown and generally illustrated at 200. In this particular embodiment a ball or spherical toggle type button 200 is shown. As disclosed above, the button 200 includes left 216 and right 218 sides joined by a shaft portion wherein the fastening means 226 extends around the shaft portion to hold the button 200 onto the substrate material 24. In this embodiment the button 200 still includes first 216 and second 218 halves that are generally defined and demarcated by a line that extends around the circumference of the button 200. The button 200 is reversed from a first ornamental side 212 to a second ornamental side 214 as described above by rotating the button 200 around the shaft portion and placing the desired ornamental side 212, 214 in the exposed viewing position. While in FIG. 6 the button 200 is shown as spherical it could also be ellipsoidal, conical, frustroconical, cylindrical, tetrahedron or any combination thereof.

Figure 7:
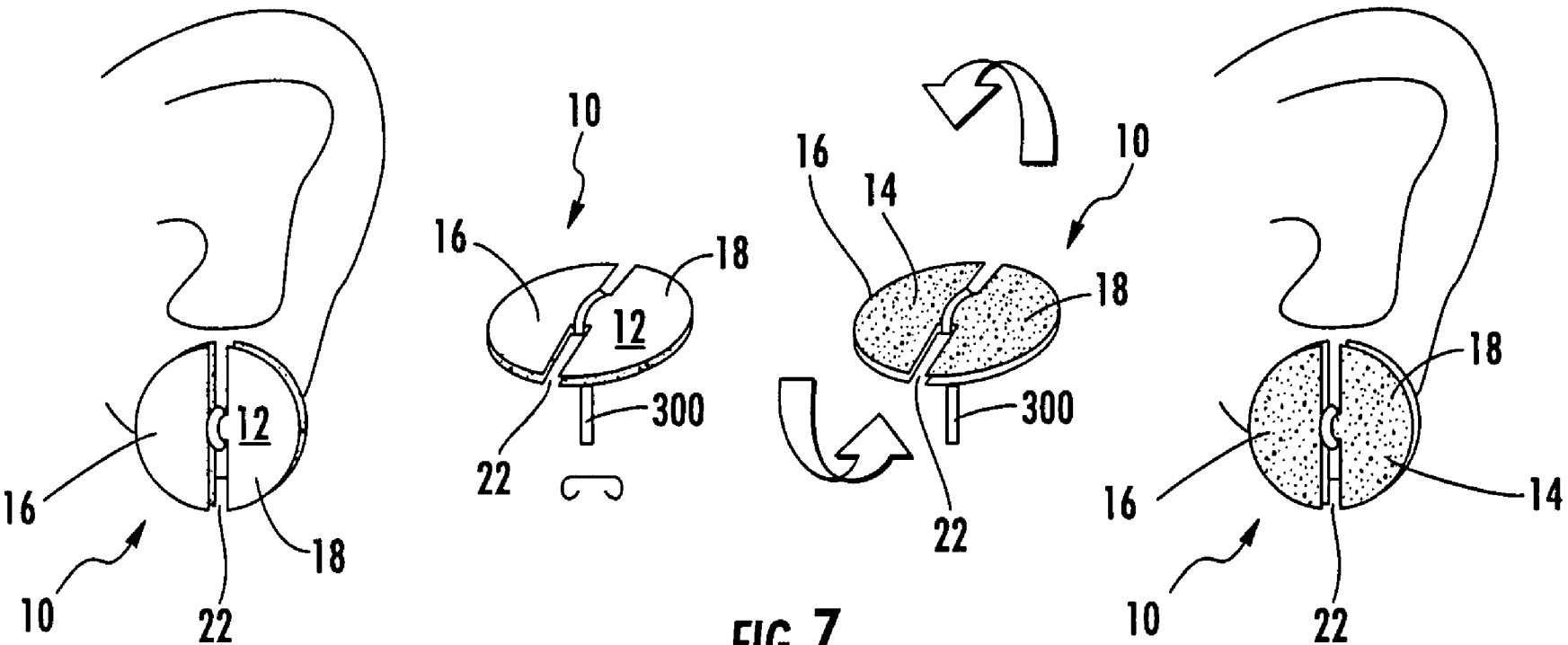
FIG. 7 is a diagrammatic view of the reversible fastener of the present invention utilized in an earring.
Figure 8:
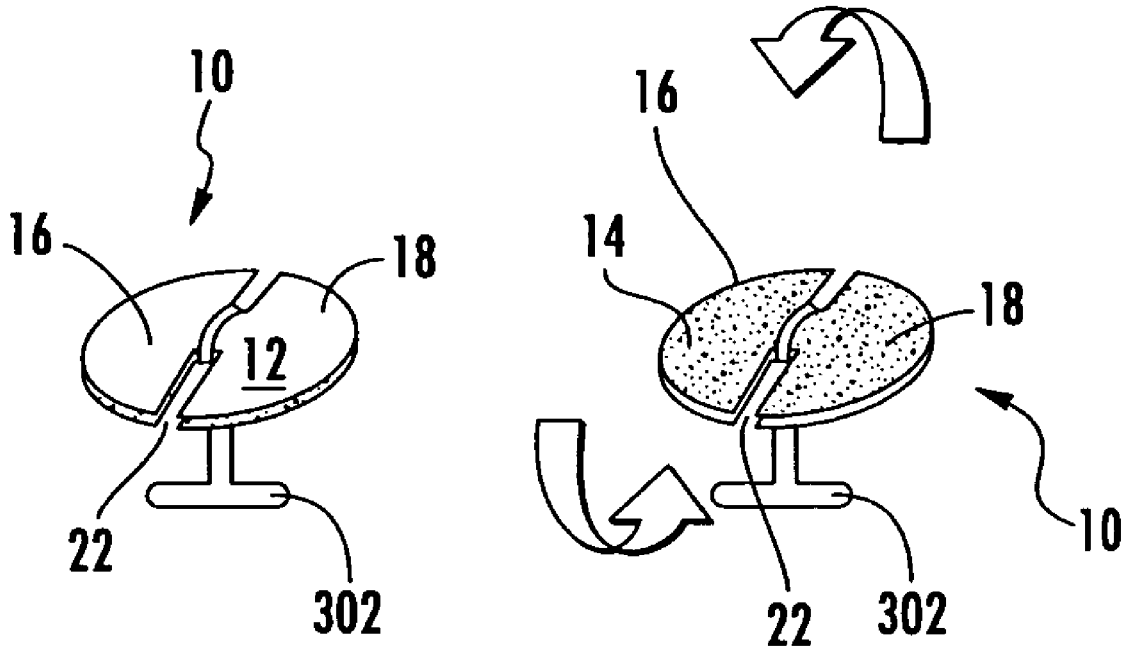
FIG. 8 is a diagrammatic view of the reversible fastener of the present invention utilized in a cuff link.
Figure 9:
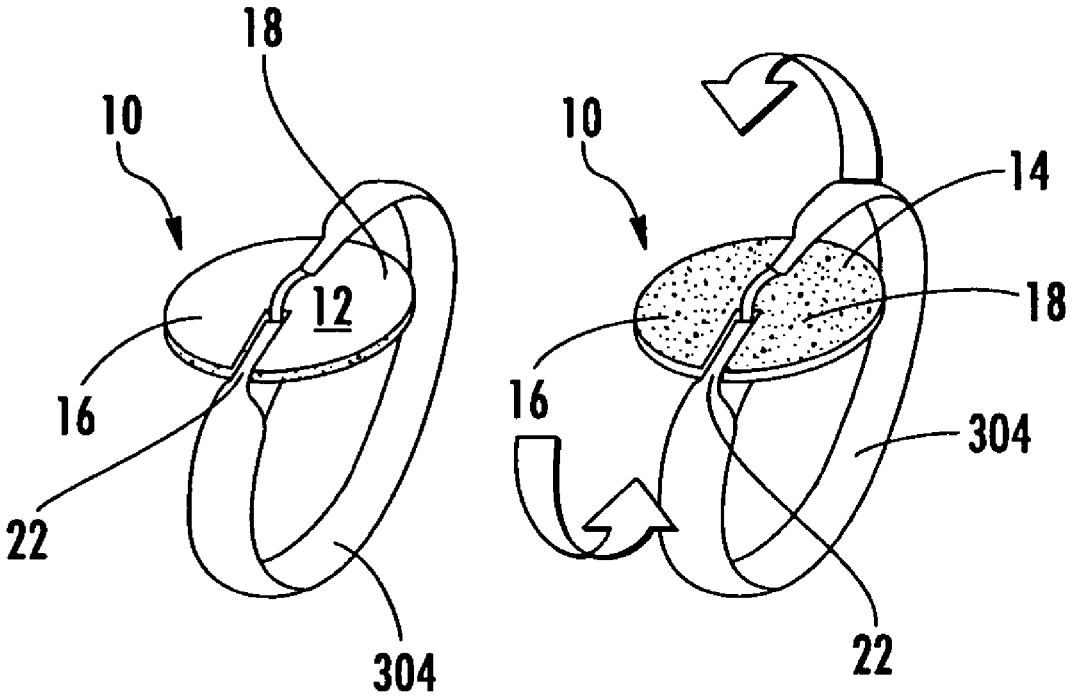
FIG. 9 is a diagrammatic view of the reversible fastener of the present invention utilized in a bracelet.

FIGS. 7, 8, 9 and 10 illustrate a variety of possible applications for the reverse fastener of the present invention. FIG. 7 shows the reverse fastener 10 as the ornamental portion of an earring. In this application, the fastening member 300 is actually the earring post 300 wrapped around the shaft portion 20 of the reversible fastener 10. As can be seen, the earring is removed from the ear, rotated into the desired display position and replaced into the wearer's ear. Similarly, FIG. 8 illustrates the reversible fastener 10 in the ornamental portion of cuff links 302. FIG. 9 places the reversible fastener 10 on a bracelet 304.

Figure 10:
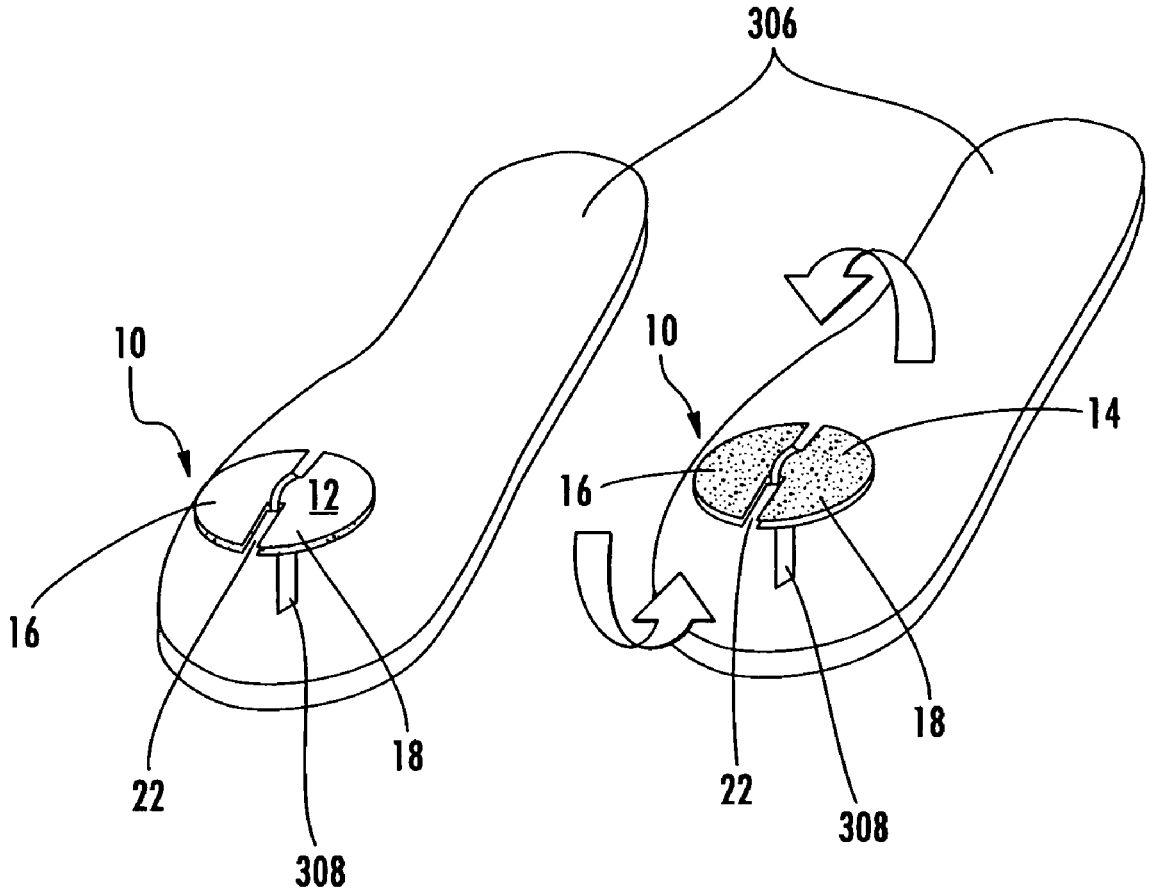
FIG. 10 is a diagrammatic view of the reversible fastener of the present invention utilized in a sandal.

FIG. 10 utilizes the reversible fastener 10 as the top portion of a thong type strap for use in sandals 306. In this application, the fastening member 308 extends upwardly from the sole of a sandal 306 and between the toes of the wearer of the sandal 306. The reversible fastener 10 resides against the top of the wearer's foot adjacent the top of the wearer's toes.

It can therefore be seen that the present invention provides a reversible fastener 10 member that has a wide applicability with regard to a broad range of garments and fashion accessories. It should be emphasized that the principal of the present invention lies in the general configuration that allows the central fastening of the button to the substrate and the rotation of the button from a first side to a second side without removing it from the substrate and is not intended to limit the invention to the particular ornamental surfaces or shapes described. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A reversible fastener assembly comprising:

a button member having a top surface, a bottom surface, a left half, a right half, a peripheral edge, a channel extending inwardly from said peripheral edge between said right half and said left half and a shaft portion extending between said left half and said right half across said channel; and a substrate material, said button being fastened to said substrate material by a fastening member that engages said substrate material and extends around said shaft portion to retain said button relative to said substrate material, wherein said top surface and said bottom surface have different ornamental appearances relative to one another and wherein said button can be rotated around said shaft portion from a first position with said bottom surface adjacent said substrate material to a second position with said top surface adjacent said substrate material without removing said button from said substrate material by folding said substrate material and passing said folded substrate material through said channel as said shaft portion is rotated within said fastening member.

2. A reversible fastener assembly comprising:

a button member having a top surface, a bottom surface, a left half, a right half, a peripheral edge, a channel extending inwardly from said peripheral edge between said right half and said left half and a shaft portion extending between said left half and said right half across said channel; and a substrate material, said button being fastened to said substrate material by a fastening member, wherein said fastening member is elastic and engages said substrate material by extending around said shaft portion to retain said button relative to said substrate material, wherein said top surface and said bottom surface have different ornamental appearances relative to one another and wherein said button can be rotated around said shaft portion from a first position with said bottom surface adjacent said substrate material to a second position with said top surface adjacent said substrate material by lifting said button from said substrate material thereby stretching said elastic fastening member, rotating said button such that said elongated fastening member passes through said channel as said shaft portion is rotated within said fastening member and releasing said button wherein said elastic fastening member returns said button to a position adjacent said substrate material.

3. The reversible fastener of claim 1, wherein said channel includes side walls that are substantially perpendicular to said top and bottom surfaces of said button.

4. The reversible fastener of claim 1, wherein said channel includes side walls that are parallel to one another and disposed at an inclined angle relative to said top and bottom surfaces of said button.

5. The reversible fastener of claim 1, wherein said left half, said right half and said shaft portion are integrally formed with one another.

6. The reversible fastener of claim 1, wherein said shaft portion and said left half are integrally formed with one another, said shaft portion having a free end and said right half is received in mated relation with said free end of said shaft.

7. The reversible fastener of claim 1, wherein said shaft portion has first and second free ends and said left half and said right half are received in mated relation to said first and second free ends of said shaft portion.

8. The reversible fastener of claim 1, further comprising:

said fastening member having a length that allows said button to rotate without pinching said substrate;

a secondary substrate with an opening therein, wherein said button is rotated to reside in a plane passing through said length of fastening member, inserted into said opening and rotated back to its original position thereby preventing removal of said secondary substrate.

9. The reversible fastener of claim 1, wherein said button member has a shape that is selected from the group consisting of: spherical, ellipsoidal, conical, frustroconical, cylindrical, tetrahedral and combinations thereof, having a channel extending around said button member between said a right side and said a left side thereof, said shaft portion extending across said channel at approximately the center of said button, said shaft portion maintaining said left side and said right side in fixed spaced relation.

10. The reversible fastener of claim 1, wherein said substrate material is a shoe sole, said fastening member having a length that allows said button to rotate without pinching said substrate material, said fastening member extending between toes on a foot of a wearer when said shoe sole is placed beneath said foot of said wearer, said button residing adjacent said toes on the top of said foot thereby retaining said shoe sole in position beneath said foot of said wearer.

11. The reversible fastener of claim 2, wherein said button member has a shape that is selected from the group consisting of: spherical, ellipsoidal, conical, frustroconical, cylindrical, tetrahedral and combinations thereof, having a channel extending around said button member between said a right side and said a left side thereof, said shaft portion extending across said channel at approximately the center of said button, said shaft portion maintaining said left side and said right side in fixed spaced relation.

* * * * *